United States Patent [19]

Poore

[11] Patent Number: 4,598,525

[45] Date of Patent: Jul. 8, 1986

[54] GLAZING SYSTEM

[75] Inventor: Albert C. G. Poore, New Malden, England

[73] Assignee: Sterling Drug Inc., New York, N.Y.

[21] Appl. No.: 766,370

[22] Filed: Aug. 16, 1985

[30] Foreign Application Priority Data

Aug. 31, 1984 [GB] United Kingdom ..... 8421969

[51] Int. Cl.[4] ..... A45D 42/00

[52] U.S. Cl. ..... 52/776; 52/208

[58] Field of Search ..... 52/776, 777, 208, 716, 52/288

[56] References Cited

U.S. PATENT DOCUMENTS 2,966,707 1/1961 Ellis .
3,387,416 6/1968 Martin .
4,052,830 10/1977 Smith ..... 52/288
4,100,325 7/1978 Summers et al. .
4,376,359 3/1983 Redman ..... 52/397 X

FOREIGN PATENT DOCUMENTS 286618 1/1914 Fed. Rep. of Germany ..... 52/776
2022670 12/1979 United Kingdom ..... 52/776

*Primary Examiner*—Carl D. Friedman
*Attorney, Agent, or Firm*—William G. Webb; B. Woodrow Wyatt; Paul E. Dupont

[57] ABSTRACT

A glazing system comprising a glass pane and a wooden frame, and a beading strip comprised of two co-extruded hardness grades of a rubber or plastic material, the harder material forming a main body portion of the beading strip and the softer grade forming a weather seal.

19 Claims, 2 Drawing Figures

GLAZING SYSTEM

BACKGROUND OF THE INVENTION (a) Field of the Invention

This invention relates to a glazing system and to a beading strip and a kit useful in such glazing system.

(b) Information Disclosure Statement

In conventional glazing systems, a pane of glass is located in place in a wooden frame by means of panel pins and is weather sealed by means of putty which is applied in the form of a triangular wedge of material. A disadvantage of the conventional glazing system is that, due to weathering and seasonal temperature changes, the putty may crack or come away from the wooden frame or the glass pane so that water can seep in and cause damp rot.

As will be seen, the prior art fails to address this problem, and it is therefore an aim of the invention to provide a glazing system whic overcomes the problem just described.

Ellis U.S. Pat. No. 2,966,707 discloses window frames adapted to receive a sheet of glass. With reference to FIG. 1 and 2, the window frame assembly comprises a frame of channel section having one wall 2 of greater height than a second wall 3. The higher wall is faced on the inside of the channel with resilient material 5, such as natural or synthetic rubber or a resilient plastic. A beading strip 6 lies within the channel abutting the lower wall 3 and pressing a sheet of glass 7 against resilient facing 5. The beading strip as an abutment surface 10 which serves to keep the edge of the glass spaced from the channel base 12. The assembly of FIG. 3 is generally similar except that the assembly is adapted to accept two panes of glass with a section of resilient material between the panes in groove 13. Although not specifically stated, the channel members used in the Ellis system are apparently of conventional extruded metal, and thus the patentee does not address problems inherent in glazing of wooden window frames.

Martin U.S. Pat. No. 3,387,416 discloses a sealing and spacing element for sealing two different elements together, such as automobile windshields to frame openings. The sealing and spacing element is composed of a shaped body of a sealant composition 11 to which there is attached a strip of cellular elastomer 12. The latter may optionally have a backing 13 of cloth or other material. As shown by FIG. 4 depicting the method of mounting the glass and sealing/spacing element, only one of the components of the sealer/spacer contacts the glass, namely the sealant composition 11, and the cellular elastomer 12 only serves to cushion the glass/sealer combination against compression.

Summer et al. U.S. Pat. No. 4,100,325 discloses weather resistant composites for use in building siding, shutters, roof vents and the like which comprise a substrate of rigid vinyl chloride polymers, chlorinated vinyl chloride polymers or acrylonitrile-butadiene-styrene polymers and a capstock containing vinyl chloride polymer, titanium dioxide and a plasticizer. The substrate and capstock may be either co-extruded or, alternatively, the capstock may be laminated to the substrate.

Thus neither Ellis nor Martin addresses the problem of glazing window panes in wooden frames so as to prevent the problem of cracking of the glazing material and resultant dry rot of the wooden frame, and although Summers et al. describe the manufacture of co-extruded or laminated two-component plastics, they do not suggest the application of such materials to the problem of glazing of wooden window frames.

SUMMARY OF THE INVENTION

In one aspect, the present invention relates to a glazing system comprising a framed pane and a beading strip comprised of two co-extruded hardness grades of a rubber or plastic material, the harder grade of material forming a main body portion of the beading strip which is shaped to fit in the region where the pane adjoins a window frame, so that in use one face of the main body portion is disposed against the pane, whilst an adjacent face of the main body portion is disposed against the window frame, the softer grade of material forming a weather seal which also engages the pane.

In another aspect, the invention relates to a co-extruded beading strip for use in a glazing system which comprises a main body portion by means of which the strip is held in place and a seal portion which is integral with the main body portion but is more flexible than the main body portion so as to form a weather seal with two sealing lips, one lip sealing against the pane and the other sealing against the frame.

In a further aspect, the invention relates to a kit of parts for use, for example, in renovating an existing glazing system and to a beading strip useful in such glazing system.

BRIEF DESCRIPTION OF THE DRAWINGS

The invention is described hereinbelow with reference to the accompanying drawings of FIG. 1 and 2, where like numbers designate like parts, which is a view in cross section of the glazing system of the invention showing the co-extruded beading in association with a glass pane and a window frame.

DETAILED DESCRIPTION OF THE INVENTION

Figure 1:
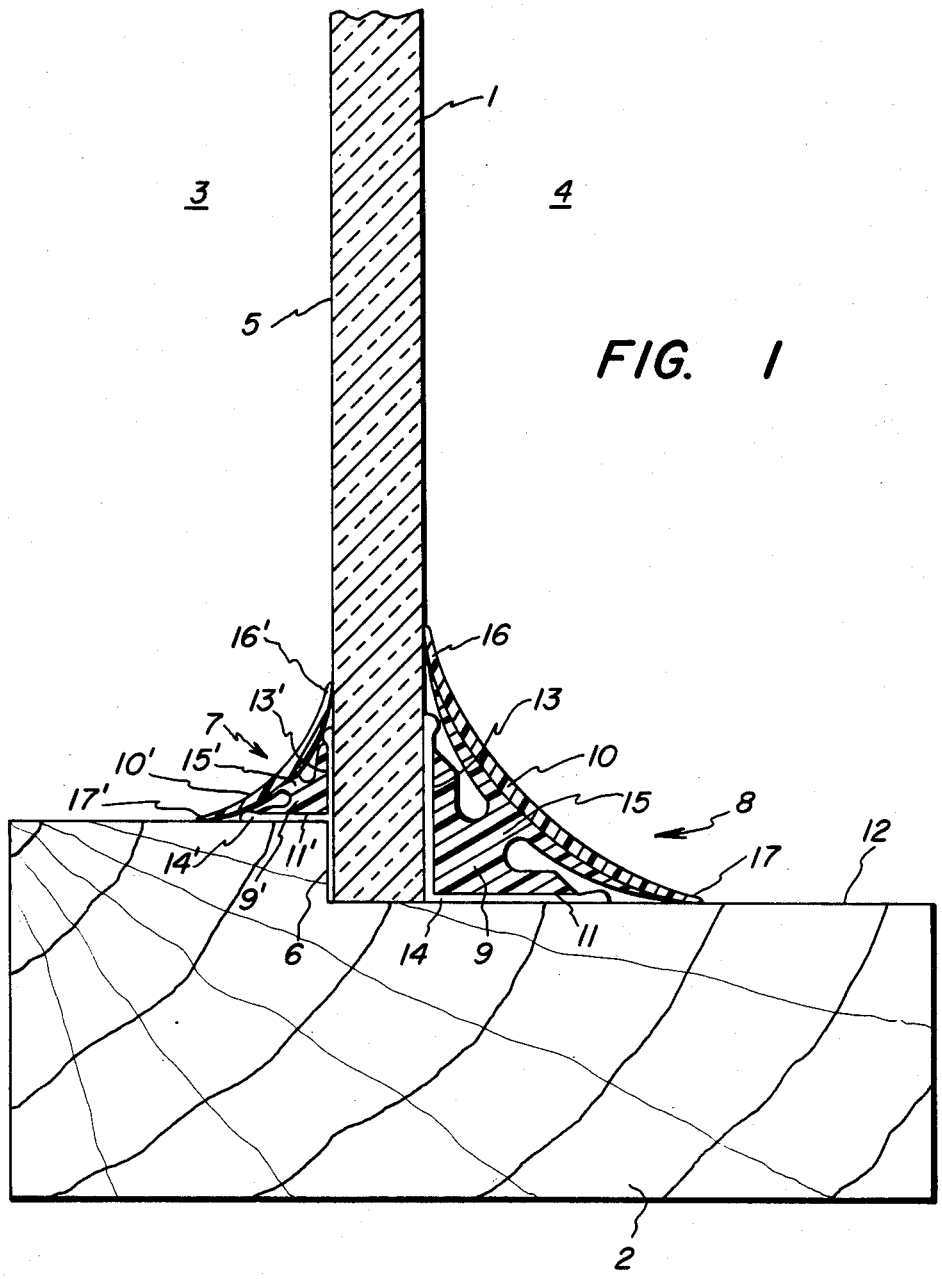
Figure 2:
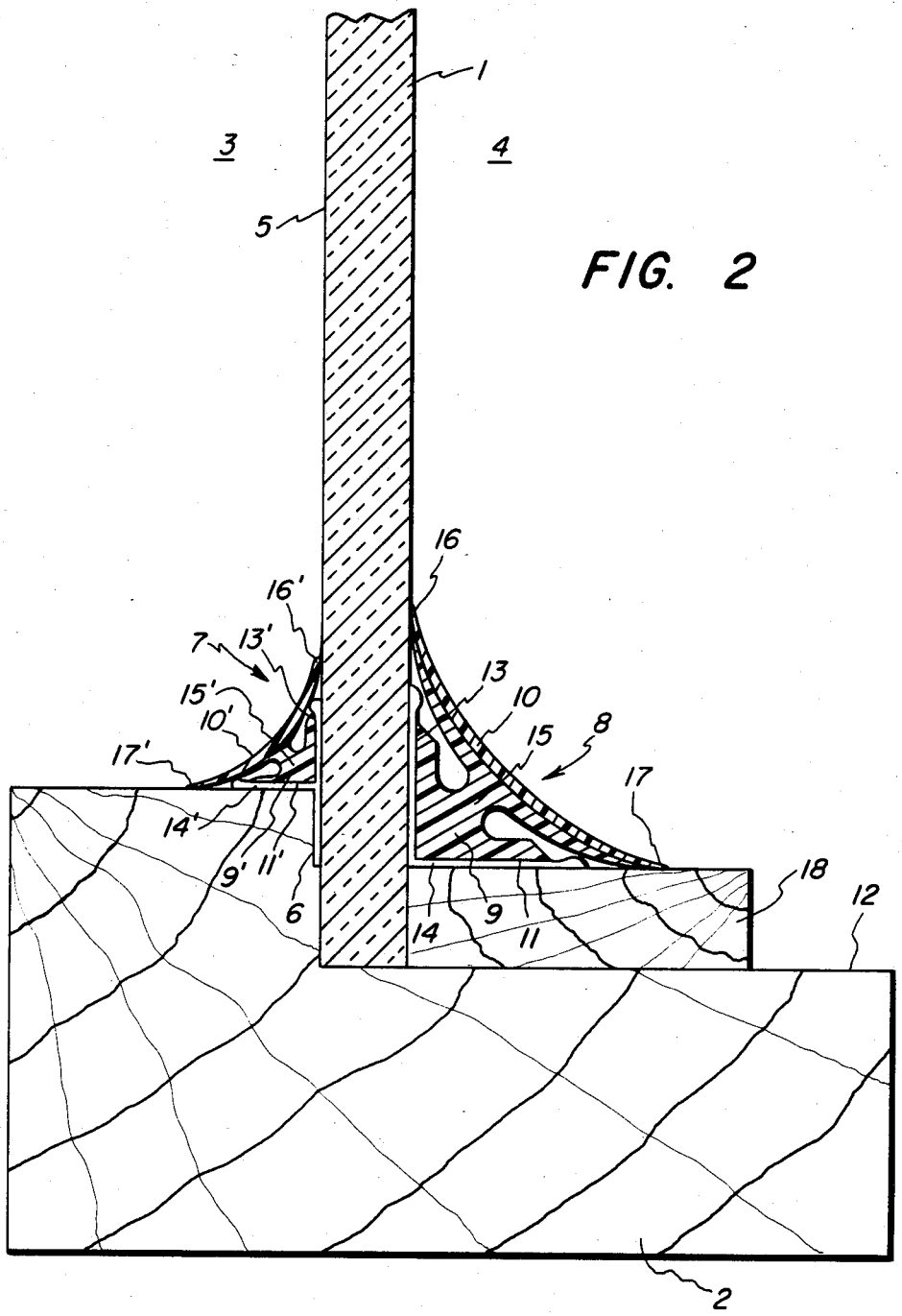

In order that the invention may be more readily understood, an embodiment of the invention will now be described by way of example and with reference to the accompanying drawing.

In the drawing, a glass pane 1 is mounted in a fixed wooden frame, although only the lower beam 2 of the frame is shown. The fixed wooden frame may be mounted in an opening in an external wall of a building, so that the region 3 lies within the building, and the region 4 is outside the building. The lower edge of the interior face 5 of the pane 1 abuts a shoulder 6 formed on the lower frame member 2.

Instead of putty or wooden glazing bead which is conventionally used, the illustrated glazing system includes an interior beading strip 7, and a similar but larger exterior beading strip 8. Both strips are co-extrusions formed of two hardness grades of a rubber or plastic material, the preferred material being polyvinyl chloride (PVC).

The exterior beading strip 8 comprises a main body portion 9 which is made of a first hardness grade of PVC, and a weather seal portion 10 which is made of a second and softer grade of PVC, the strip being manufactured by co-extruding the two grades of PVC to form an integral strip. The main body portion 9 occupies a position which would be occupied by putty in a conventional glazing system. One flat face 11 of the main body portion seats against a face 12 of the frame part 2, whilst a second flat face 13 of the main body portion which extends at a right angle to the face 11 is disposed against the pane 1. Any suitable means may be used to secure the beading strip in its illustrated position, but it is preferred to use an adhesive applied to the faces 11 and 13 of the main body portion or applied to those surfaces of the pane and frame which will be engaged by faces 11 and 13. The adhesive should have good sealant properties to prevent seepage of water between the wooden frame and the beading strip and should not "age" too quickly. A suitable mastic adhesive is shown at 14.

The main body portion 9 is formed as a solid wedge of material, and the sealing portion 10 of the beading strip is attached to the main body portion by a narrow spine 15. The weather sealing portion 10 entirely spans the gap between the pane and the frame, so that one lip 16 of the sealing portion engages the pane 1, and another lip 17 of the sealing portion engages the frame 2. The region where the sealing lip 16 engages the pane is spaced from the region where the main body portion 9 engages the pane, and similarly the region where the sealing lip 17 engages the frame is spaced from the region where the main body portion engages the frame. This assists in forming a good seal should the main body portion of the beading strip deviate from a straight line as will be described below.

The interior beading strip 7 is similar to the exterior strip 8 and does not require detailed description. The strip 7 is of smaller cross-section than the strip 8, and as can be seen the adhesive 14' on the interior of the window also extends between the pane 1 and the frame 2. The interior beading strip 7 has similar parts or portions 9', 10', 11', 13', 14', 15', 16' and 17' performing the same functions as similarly numbered parts of exterior beading strip 8.

A glazing system according to this invention can be used when the glass is originally fitted, but it is also contemplated that the invention may be marketed in the form of a kit of parts to be used in renovating existing glazing systems which originally used putty or wooden glazing beads. For example, the kit might contain one or more lengths of beading strip; a suitable adhesive; wood filling or treading compounds and instructions for use.

In order to renovate an existing glazing system, one could proceed as follows. Firstly the old putty would be removed, and the existing wooden frame and/or glazing bead would be treated as necessary to make it sound and free from cracks or holes. Suitable products for treating the wood might include "Ronseal" wood hardener, "Ronseal" wood filler or "Ronseal" wood preservative tablets, these products being marketed by the company Sterling Roncraft. "Ronseal" is a Registered Trademark. When the existing wooden frame or glazing bead is suitably treated, the beading strip will be cut to the required lengths and mitred and fitted in place of the old putty using the adhesive or fitted in a similar way to the renovated glazing bead.

It is hoped that, in the renovated glazing system, the beading strip will serve not merely as a replacement for putty, but will serve better than putty in preventing rain or condensation from attacking the wooden frame.

In a glazing system according to the invention it may in some circumstances by considered appropriate to rely solely on the adhesively secured main body portion of the beading strip to hold the pane in place. However, additional securing means may be needed in other circumstances. For example, panel pins which are used in conventional putty glazing systems could be used. The pins are driven for part of their length into the wooden frame parallel to the pane, so that the head regions of the pins stand proud from the frame to retain the pane in place. In this case the main body portion of the beading strip would not be able to seat exactly flat against the pane because of the intervening panel pins. However, this would not matter, because the adhesive would form a seal in the region of the pins to render the region between the pane and the main body portion of the beading strip watertight.

The use of panel pins would also mean that the main body portion of the seal would deviate from a straight line as has been mentioned above, but because the sealing portion is flexible and is spaced from the main body portion, it can reliably seal against the pane. Another way of securing the glass more firmly would be to lift the sealing portion of the strip out of the way and drive panel pins through the main body portion and into the wooden frame. The sealing portion would be released to cover the head of the pin. With this arrangement, it might be possible to use a sealant without adhesive properties instead of the adhesive with sealant properties.

The glazing system just described has two main distinctive features. One feature is the use of a co-extruded beading strip in a region normally occupied by putty, making the system easy to use by a "do-it-yourself" handyman renovating an existing putty system. Another feature is the use of a beading strip having two soft sealing lips, one engaging the pane and the other the wooden frame. This feature enhances the watertightness of the seal.

Although the system has been described for use with a fixed window frame, it could also be used with a frame designed to open.

Although only the glazing of the lower edge of the wooden frame is shown in the drawing, the other three edges can be glazed in similar fashion. In this case, care must be taken where two beading strips meet at the corner of the frame. The abutting ends of the strips would need to be cut at the correct angle using a mitre block, and such a block could be included in the kit of parts mentioned above. Adhesive should also be carefully applied where the ends of the strip meet to insure a good seal between the ends of the strips.

I claim:

1. A glazing system comprising a framed pane and a beading strip comprised of two co-extruded hardness grades of a rubber or plastic material, the harder grade of material forming a main body portion of the beading strip which is shaped to fit in the region where the pane adjoins a window frame, so that in use one face of the main body portion is disposed against the pane, whilst an adjacent face of the main body portion is disposed against the window frame, the softer grade of material forming a weather seal which also engages the pane.

2. A glazing system according to claim 1 in which the weather seal is formed with two sealing lips, one lip sealing against the pane, and the other lip sealing against the frame.

3. A glazing system according to claim 2 in which the region where a said sealing lip engages the pane is spaced from the region where the main body portion engages the pane.

4. A glazing system according to claim 3 in which the main body portion is retained in place at least partly by an adhesive applied between the main body portion and the frame and pane.

5. A glazing system according to claim 4 in which the main body portion of the beading strip is made of a first hardness grade of PVC, and the weather seal is made of a second and softer grade of PVC.

6. A glazing system according to claim 2 in which the region where a said sealing lip engages the frame is spaced from the region where the main body portion engages the frame.

7. A glazing system according to claim 6 in which the main body portion is retained in place at least partly by an adhesive applied between the main body portion and the frame and pane.

8. A glazing system according to claim 7 in which the main body portion of the beading strip is made of a first hardness grade of PVC, and the weather seal is made of a second and softer grade of PVC.

9. A glazing system according to claim 1 in which the main body portion of the beading strip is formed as a solid wedge of material having two faces at right angles to one another which are disposed one against the frame and the other against the pane, the weather seal being attached to another face of the main body portion.

10. A glazing system according to claim 9 in which the weather seal is attached to the main body portion by means of a narrow spine.

11. A beading strip for use in a glazing system according to claim 1, the strip being a co-extrusion comprised of two hardness grades of a rubber or plastic material, the harder grade of material forming a main body portion of the beading strip which is shaped to fit in a region where a pane adjoins a window frame, so that in use one face of the main body portion is disposed against the pane, whilst an adjacent face of the main body portion is disposed against the window frame, the softer grade of material serving to form a weather seal which will engage the pane.

12. A beading strip according to claim 11 in which the weather seal is formed with two sealing lips, one lip serving in use to seal against the pane, and the other lip serving in use to seal against the frame.

13. A beading strip according to claim 12 in which the weather strip is attached to the main body portion by means of a narrow spine and is so shaped that in use a sealing lip engages the pane at a point spaced from the region where the main body portion engages the pane.

14. A beading strip according to claim 13 in which the main body portion of the beading strip is made of a first hardness grade of PVC, and the weather seal is made of a second and softer grade of PVC.

15. A beading strip according to claim 12, in which the weather strip is attached to the main body portion by means of a narrow spine and is so shaped that in use a sealing lip engages the frame at a point spaced from the region where the main body portion engages the frame.

16. A beading strip according to claim 15 in which the main body portion of the beading strip is made of a first hardness grade of PVC, and the weather seal is made of a second and softer grade of PVC.

17. A beading strip for use in a glazing system according to claim 11, said strip comrising a main body portion formed as a solid wedge of material having two faces at right angles to one another which are disposed one against the frame and the other against the pane, the weather seal being attached to another face of the main body portion.

18. A beading strip according to claim 17 in which the weather seal is attached to the main body portion by means of a narrow spine.

19. A kit of parts comprising a beading strip according to claim 11, an adhesive and means for filling and preserving wood.

* * * * *

UNITED STATES PATENT AND TRADEMARK OFFICE

CERTIFICATE OF CORRECTION

PATENT NO. : 4,598,525

DATED : July 8, 1986

INVENTOR(S) : Albert C.G. Poore

It is certified that error appears in the above-identified patent and that said Letters Patent is hereby corrected as shown below:

Column 1, line 20, "whic" should read --which--; line 31, "as" should read --has--; and line 54, "Summer" should read --Summers--.

Column 3, line 64, "by" should read --be--.

Signed and Sealed this

Twenty-fifth Day of September, 1990

*Attest:*

HARRY F. MANBECK, JR.

*Attesting Officer*

*Commissioner of Patents and Trademarks*